United States Patent [19]

Sasaki et al.

[11] Patent Number: 4,710,600

[45] Date of Patent: Dec. 1, 1987

[54] DETENT MECHANISM FOR SLIDING ELECTRIC PARTS

[75] Inventors: Shinji Sasaki, Miyagi; Yujiro Shimoyama; Yoshinori Watanabe, both of Furukawa, all of Japan

[73] Assignee: Alps Electric Co., Ltd., Japan

[21] Appl. No.: 779,151

[22] Filed: Sep. 23, 1985

[30] Foreign Application Priority Data

Sep. 21, 1984 [JP] Japan ..... 59-143134[U]

[51] Int. Cl.[4] ..... H01H 15/10

[52] U.S. Cl. ..... 200/291; 200/16 C

[58] Field of Search ..... 200/327, 291, 16 C

[56] References Cited

U.S. PATENT DOCUMENTS

| | | | |
|---|---|---|---|
| 2,413,135 | 12/1946 | Baumgardner | 200/16 C |
| 3,582,578 | 6/1971 | Lockard | 200/291 |
| 4,268,728 | 5/1981 | Rose | 200/291 |
| 4,316,067 | 2/1982 | Whiteman, Jr. | 200/291 |
| 4,417,107 | 11/1983 | Terajima | 200/16 C |

FOREIGN PATENT DOCUMENTS

| | | | |
|---|---|---|---|
| 260332 | 2/1968 | Austria | 200/16 C |
| 777877 | 2/1968 | Canada | 200/16 C |
| 1095768 | 12/1967 | United Kingdom | 200/291 |

OTHER PUBLICATIONS

IBM Technical Disclosure Sliding Selector Switch, J. W. Rudolph, vol. 22, No. 6, Nov. 1979, pp. 2324–2325.

*Primary Examiner*—Henry J. Recla
*Assistant Examiner*—Linda J. Sholl
*Attorney, Agent, or Firm*—Guy W. Shoup

[57] ABSTRACT

Herein disclosed is a detent mechanism for a detent mechanism for use in a sliding electric part, in which an operation lever exposed to the outside from a casing is slid for operations, such as a slide switch or a volume control for audios. In the detent mechanism, a slide guide formed in a casing is formed with a series of cam crests. There is fixed to an operation lever an engaging member which engages with those cam crests. At least one of the slide guide and the engaging member is given such an elasticity as to tighten the engagement.

1 Claim, 8 Drawing Figures

DETENT MECHANISM FOR SLIDING ELECTRIC PARTS

BACKGROUND OF THE INVENTION

1. Field of the Invention

The present invention relates to a sliding electric part, in which an operation lever exposed to the outside from a casing is slid for operations, such as a slide switch or a volume control for audios and, more particularly, to a detent mechanism for use with the sliding electric part.

2. Description of the Prior Art

Taking up the slide switch as an example, the detent mechanism shown in FIG. 8 is known as the above-specified kind in the prior art. As shown in FIG. 8, more specifically, reference numeral 1 indicates a casing, and numeral 2 indicates a slider which is cased in the casing 1 and which is formed integrally with an operating lever 3 protruding to the outside from the casing 1. That slider 2 is formed with a vertically through hole 4, in which are fitted a coil spring 5 and balls 5 biased at all times outward by the action of the coil spring 5.

On the other hand, the casing 1 is formed with click holes 7 and 7 in positions corresponding to the through hole 4 of the slider 2. As the slider 2 slides, the balls 6 and 6 are brought into engagement with those click holes 7 and 7 by the biasing force of the coil spring 5, thus constructing a detent mechanism.

In FIG. 8, incidentally, numerals 8 and 8 indicate contacts, and numeral 9 indicates a wafer which is equipped with terminals 9*a*.

The detent mechanism of the sliding electric part of the prior art has the construction described above. This construction never fails to be formed between the casing 1 and the slider 2 with clearances $\alpha$ and $\beta$, which allow the slider 2 to slide in the casing 1.

However, the presence of those clearances $\alpha$ and $\beta$ produces looseness by all efforts, and therefore the detent mechanism of the prior art has defects that it has a bad operating feeling and that the operation lever sometimes overruns the target position.

SUMMARY OF THE INVENTION

It is, therefore, an object of the present invention to provide a detent mechanism for a sliding electric part, which is freed from the above-specified defects of the prior art.

Another object of the present invention is to provide an improved detent mechanism of the above type, which has no looseness to offer an improved operating feeling and to effect a targeted positioning snugly.

In order to achieve these objects, the detent mechanism according to the present invention is characterized in that a slide guide formed in a casing is formed with a series of cam crests, in that there is fixed to an operation lever an engaging member which engages with those cam crests, and in that at least one of the slide guide and the engaging member is given such an elasticity as to tighten the engagement.

According to a major feature of the present invention, in a sliding electric part including: a casing having a slit; and an operation lever inserted in the slit of said casing and protruding therefrom to the outside, according to a major feature of the present invention, there is provided a detent mechanism comprising: a slide guide formed in said casing and having a series of cam crests for guiding the sliding movements of said operation lever; and an engaging member fixed to said operation lever and adapted to engage with the cam crests of said slide guide, wherein the improvement resides in that at least one of said slide guide and said engaging member is made so elastically biased as to come into contact with the other.

BRIEF DESCRIPTION OF THE DRAWINGS

Other objects, features and advantages of the present invention will become more apparent from the following description taken in connection with one embodiment thereof with reference to the accompanying drawings, in which.

DESCRIPTION OF THE PREFERRED EMBODIMENTS

Figure 1:
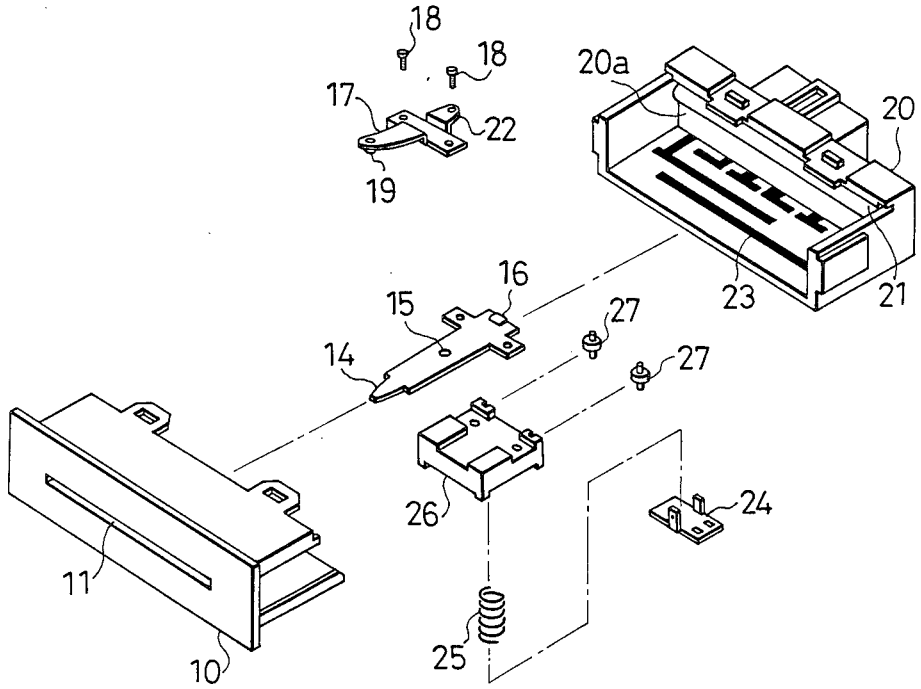
FIG. 1 is an exploded perspective view showing a slide switch equipped with a detent mechanism according to the present invention.
Figure 2:
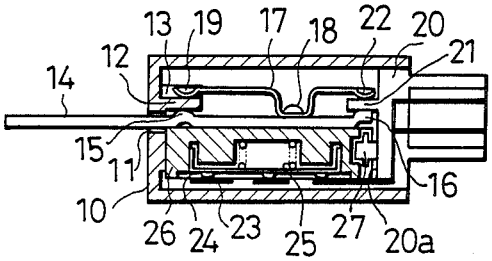
FIG. 2 is a longitudinal section showing the slide switch.

The present invention will be described in the following in connection with one embodiment thereof with reference to FIGS. 1 to 7.

Indicated at reference numeral 10 is a casing which is formed in its front plate with a slit 11 in which is inserted the leading end of a later-described operation lever. The casing 10 is also formed integrally with a slide guide 12 for sliding the operation lever, which is located at the back of the front plate of the casing and slightly above the slit 11. The slide guide 12 is formed on its upper face with a series of cam crests 13, 13 and so on.

The operation lever, which is now indicated at numeral 14, is so inserted in the slit 11 of the casing 10 as to protrude to the outside. The operation lever 14 is formed at its generally central portion with an upward protrusion 15, which is to come into abutment against the lower face of the slide guide 12 of the casing 10, and at its rear end with an upward protrusion 16 which is to come into abutment against the lower face of the slide guide of a later-described wafer.

On the upper face of that operation lever 14, there is fixed by means of screws 18 and 18 a leaf spring member 17 which is formed at its leading end with a downward engaging protrusion 19. This engaging protrusion 19 is in sliding engagement with the cam crests 13, 13 and so on of the aforementioned slide guide 12 of the casing 10. This slide guide 12 is held between that engaging protrusion 19 and the upward protrusion 15 of the operation lever 14 so that the leaf spring member 17 is caused as a result of its fixture to the operation lever 14 by the screws 18 and 18 to urge the upward protrusion 15 of the operation lever 14 onto the lower face of the slide guide 12.

Moreover, the leaf spring member 17 is formed at its rear end with a downward protrusion 22 which is in abutment against the upper face of a slide guide 21. This slide guide 21 is formed in a wafer 20 which is assembled with the casing 10. That downward protrusion 22 and the upward protrusion 16 of the operation lever 14 coact to hold the slide guide 21 of the wafer 20.

From the wafer 20, there is exposed a contacting portion 23 which is printed thereon. A contact 24 to come into sliding contact with that contacting portion 23 is fitted on the bottom of a slider 26 such that it is biased downward by the action of a coil spring 25.

The slider 26 is so fixed to the lower face of the operation lever as to operate integrally with the operation lever 14 by fastening the aforementioned screws 18 and 18 through the operation lever 14. To the rear end face of that slider 26, moreover, there are attached a pair of rollers 27 and 27 which are in contact with the inner face 20*a* of the upright wall of the wafer 20.

Figure 3:
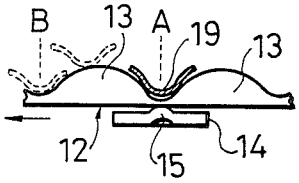
FIG. 3 is a schematic front elevation for explaining the operations of the detent mechanism of the present invention.
Figure 4:
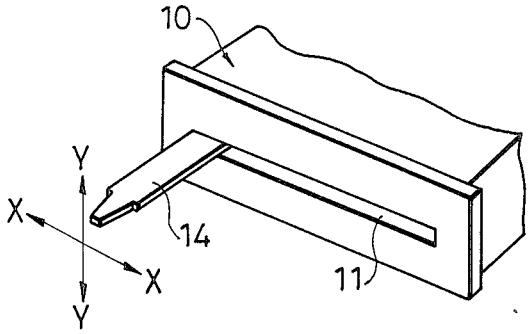
FIG. 4 is a perspective view showing a portion of the same detent mechanism.

Here, when the operation lever 14 is moved in the direction of arrow, as shown in FIG. 3, the engaging protrusion 19 of the leaf spring member 17 is shifted on the cam crests 13, 13 and so on of the slide guide 12 from a point A to a point B. During this shifting movement, the upward protrusion 15 of the operation lever 14 is urged onto the lower face of the slide guide 12 at all times by the elastic force of the leaf spring member 17 to produce no looseness in the vertical directions, as indicated at Y—Y in FIG. 4. In the horizontal directions, as indicated at X—X, too, occurrence of the looseness is suppressed by the elastic, frictional forces which are generated between the engaging and downward protrusions 19 and 22 of the leaf spring member 17 holding the slide guide 12 and the slide guide 21 of the wafer 20 and the upward protrusions 15 and 16 of the operation lever 14.

Figure 5:
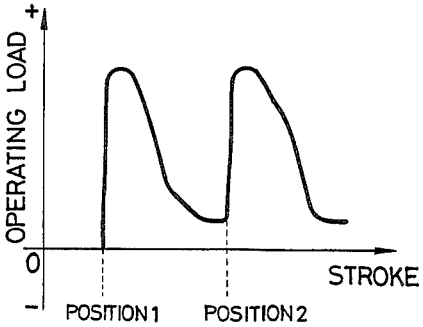
FIG. 5 is a graph showing a feeling curve of the same detent mechanism.

On the other hand, FIG. 5 is a graph showing a feeling curve in case the present embodiment thus made is used. In this graph, the operating load is plotted against the stroke of the operation lever 14.

With reference to the graph shown in FIG. 5, it is understood that the roller 19 can roll sufficiently snugly to move from the point A to the point B, as shown in FIG. 3.

Figure 6:
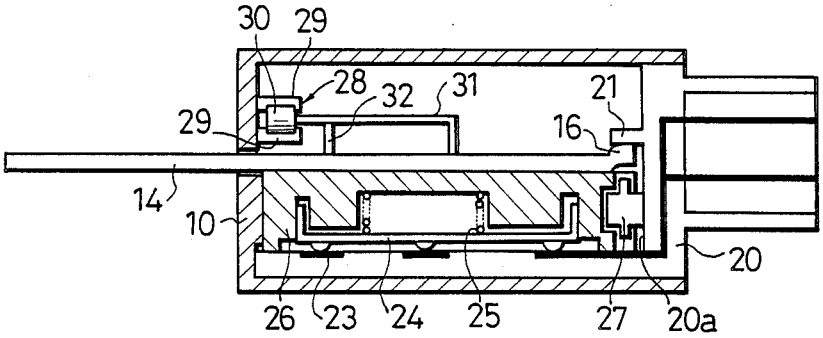
FIG. 6 is a longitudinal section showing a modification of the embodiment of the present invention.
Figure 7:
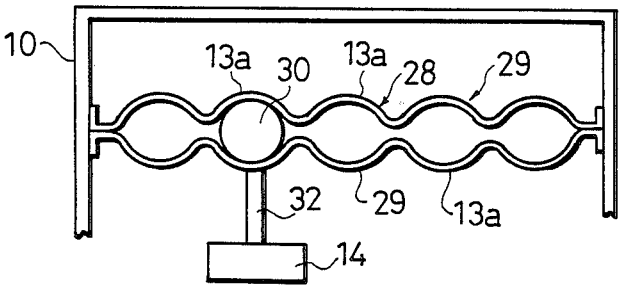
FIG. 7 is a schematic front elevation for explaining the operations of the modification.
Figure 8:
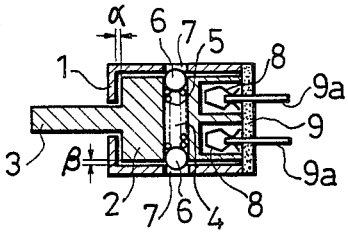
Fig. 8 PRIOR ART
FIG. 8 is a longitudinal section showing an example of the prior art.

Turning now to FIGS. 6 and 7, there is shown a modification of the embodiment of the present invention, in which reference numeral 28 indicates a slide guide which is mounted on the casing 10. This slide guide 28 is constructed of a pair of corrugated leaf spring members 29 and 29 which are formed with a series of cam crests 13*a*, 13*a* and so on inbetween and which have their two ends fixed to the inner faces of the side walls of the casing 10.

Moreover, numeral 30 indicates an engaging cylindrical member which is carried on the leading end of a supporting lever 31 fixed to the upper face of the operation lever 14. The engaging member 30 thus constructed is held between the corrugated leaf spring members 29.

Incidentally, indicated at numeral 32 is a reinforcing lever which is used for reinforcing the engaging member 30 against the rocking motions and frictional force of the latter when the engaging member 30 moves between said corrugated leaf springs 29 and 29.

Incidentally, this modified embodiment can be practised if one of the paired corrugated leaf spring members 29 and 29 is replaced by a smooth rail.

Although the embodiments have been described by taking up the slide switch as an example, the present invention should not be limited thereto but can naturally be applied to and practised by the sliding electric parts such as the volume control of audios without any difficulty.

As has been described hereinbefore, according to the present invention, the detent mechanism of the sliding electric part can be freed from both any looseness to enjoy a good operating feeling any run over the targeted positioning, as is different from the prior art, so that it can perform accurate operations.

What is claimed is:

1. In a sliding electric switch of the type having a casing with an elongated linear slit formed horizontally in a front wall of the casing and an operation lever disposed in the casing so as to move linearly along the slit, the lever having a portion extending outside the casing for operation by the user, the improvement comprising:

means in said casing and including a portion of said operation lever disposed in said casing for constraining said lever for movement in parallel with said slit;

a slide guide formed integrally with said front wall of said casing on an upper side of said slit having a corrugated surface with a series of cam crests on an upper face of said slide guide extending parallel to said slit;

an engaging member fixed to said operation lever and having an end disposed on said corrugated surface to engage said cam crests in a series of corresponding detent positions as said operation lever is moved along said slit; and means for biasing at least one of said slide guide and said end of said engaging member in pressing engagement with each other despite their relative movement across said cam crests and without any looseness, said biasing means being constituted by said engaging member being a leaf spring fixed to an upper side of said operation lever at an intermediate position thereof with a downward protrusion formed at its end in engagement with said cam crests, and by an upward protrusion formed on the upper side of said operation lever slidably in contact with a lower face of said slide guide for elastically clamping said downward protrusion of said leaf spring to said corrugated surface of said slide guide.

* * * * *